US006722169B2

(12) United States Patent
Segawa

(10) Patent No.: US 6,722,169 B2
(45) Date of Patent: Apr. 20, 2004

(54) DOOR LOCKING HANDLE ASSEMBLY

(75) Inventor: Shirou Segawa, Tokyo (JP)

(73) Assignee: Takigen Manufacturing Co. Ltd., Tokyo (JP)

( * ) Notice: Subject to any disclaimer, the term of this patent is extended or adjusted under 35 U.S.C. 154(b) by 32 days.

(21) Appl. No.: 10/459,246

(22) Filed: Jun. 11, 2003

(65) Prior Publication Data

US 2003/0196463 A1 Oct. 23, 2003

Related U.S. Application Data

(62) Division of application No. 10/081,693, filed on Feb. 22, 2002.

(30) Foreign Application Priority Data

Mar. 7, 2001 (JP) ..... 2001-062719

(51) Int. Cl.[7] ..... E05B 13/10

(52) U.S. Cl. ..... 70/208; 70/213; 70/284; 70/215; 70/DIG. 63

(58) Field of Search ..... 70/208, 284–285, 70/210, 213–215, 219, DIG. 63, 312, 449, 315–318, 331, 442, 443, DIG. 1, DIG. 44, DIG. 59

(56) References Cited

U.S. PATENT DOCUMENTS

| | | | | | |
|---|---|---|---|---|---|
| 3,416,337 | A | * | 12/1968 | Hutchins | 70/284 |
| 4,557,122 | A | * | 12/1985 | Hwang | 70/312 |
| 4,671,088 | A | * | 6/1987 | Jeang | 70/312 |
| 5,345,798 | A | * | 9/1994 | Nakai | 70/284 |
| 5,440,905 | A | | 8/1995 | Yamada | 70/208 |
| 5,450,735 | A | | 9/1995 | Esaki et al. | 70/208 |
| 5,452,596 | A | | 9/1995 | Yamada | 70/208 |
| 5,454,239 | A | | 10/1995 | Esaki et al. | 70/208 |
| 5,457,971 | A | | 10/1995 | Yamada | 70/208 |
| 5,467,623 | A | | 11/1995 | Yamada et al. | 70/208 |
| 5,469,725 | A | | 11/1995 | Yamada | 70/208 |
| 5,556,145 | A | | 9/1996 | Takasaki | 292/336.3 |
| 6,039,363 | A | | 3/2000 | Sigimura et al. | 292/202 |
| 6,490,896 | B2 | | 12/2002 | Segawa | 70/208 |
| 6,508,089 | B1 | * | 1/2003 | Tsai | 70/213 |
| 6,513,356 | B1 | * | 2/2003 | Yang | 70/213 |
| 6,516,641 | B1 | | 2/2003 | Segawa | 70/208 |
| 6,598,434 | B2 | * | 7/2003 | Yang | 70/213 |
| 6,619,083 | B2 | * | 9/2003 | Hartel et al. | 70/208 |
| 2002/0124608 | A1 | * | 9/2002 | Segawa | 70/208 |
| 2002/0139155 | A1 | | 10/2002 | Franzen | 70/209 |
| 2002/0184930 | A1 | | 12/2002 | Segawa | 70/208 |
| 2002/0189304 | A1 | | 12/2002 | Segawa | 70/208 |
| 2003/0024528 | A1 | | 2/2003 | Segawa | 70/208 |

* cited by examiner

*Primary Examiner*—John B. Walsh
(74) *Attorney, Agent, or Firm*—Martin Smolowitz

(57) ABSTRACT

Although a door locking handle assembly is small as a whole in thickness, it permits through a computerized personal management system of users a plurality of persons or users to have access to instruments contained in a box provided with the door locking handle assembly in an easy manner. In the assembly, a combination lock (19) opened by turning each of a set of it specially marked dial discs (21) a given number of times to establish a unique combination of marks of the dial discs (21) is incorporated in a door handle (13) or a base body (1) of the assembly. In operation, a locking member (44) of the assembly prevents the door handle (13) from being pulled out of the base body (1), and is driven to reach its unlocked position when the combination lock (19) is opened. Also, a cylinder lock (59) may be advantageously incorporated into the door handle (13) together with the combination lock (19).

7 Claims, 15 Drawing Sheets

DOOR LOCKING HANDLE ASSEMBLY

This application is a Divisional of Ser. No. 10/081,693 filed Feb. 22, 2002.

BACKGROUND OF THE INVENTION

1. Field of the Invention

The present invention relates to a door locking handle assembly of a pull-out and side-swinging lever-action type, in which a door handle is pivoted to a base body of the assembly so as to be pulled out and pushed down relative to the base body and turned on its pivoted end.

2. Description of the Related Art

As is well known in the art, a conventional door locking handle assembly has a construction in which: a base body of the assembly is fixedly mounted on a door; a door handle is pivoted to the base body so as to be pulled out and pushed down relative to the base body and further turned on its pivoted end; when the door handle is pulled out of the base body to assume its pulled-up or inclined position relative to the base body or turned after such pulling-out operation, a lock plate which is directly or indirectly connected with the door handle is released from a receiving portion of a stationary frame element. In this type of conventional door locking handle assembly, a cylinder lock is incorporated in either the door handle or the base body. On the other hand, the door handle is pushed down relative to the base body and held in its pushed-down or locked position in the base body.

In the conventional door locking handle assembly, an available space for mounting the assembly is extremely limited in each of opposite sides of the door to which the assembly is mounted because the interior space of a box or container for housing various instruments therein is relatively narrow due to the presence of the instruments housed in the box. Due to this, it is necessary to considerably limit in size the projections of the assembly in opposite directions perpendicular to the door's surfaces.

In order to fulfill the above need, it is necessary to reduce in thickness the assembly as a whole by reducing in thickness the door handle and in depth the base body. However, this forces a cylinder lock of the assembly to be thin in construction.

On the other hand, in a thin-type cylinder lock, since the number of sets of disc tumblers and/or pin tumblers incorporated in the cylinder lock as its internal locking mechanism is small, the number of available keys of the cylinder lock is naturally limited. Due to this, in the case where there are a large number of eligible users of the instruments contained in the box provided with the door locking handle assembly using the cylinder lock in a condition in which these users are controlled through a computerized personal management system, it is difficult to employ the conventional door locking handle assembly which uses the thin-type cylinder lock.

Although the conventional door lock handle assembly described above has been fully appreciated by users, a need exists in the art for an improved one of such door lock handle assembly, which is improved in performance.

SUMMARY OF THE INVENTION

Under such circumstances, the present invention was made. Consequently, it is an object of the present invention to provide a door locking handle assembly, which is thin in construction as a whole and capable of providing a very large number of available keys of a combination lock incorporated in the assembly, wherein a large number of eligible persons or users of various instruments contained in a box or container provided with the door locking handle assembly are precisely controlled through a computerized personal management system.

In accordance with a first aspect of the present invention, the above object of the present invention is accomplished by providing:

In a door locking handle assembly provided with a base body which is fixedly mounted on a door, wherein a door handle is pivoted to the base body so as to be capable of being pulled out and pushed down relative to the base body and also turning on its pivoted end, wherein a lock plate directly or indirectly connected with the door handle is disengaged from a receiving portion of a stationary frame element such as a main body of a box when the door handle is pulled out and turned or turned after its pulling-out operation, the improvement wherein:

a combination lock, which is provided with a plurality of marked dial disks, is incorporated in either the door handle or the base body and opened by turning each of the marked dial disks a given number of times to establish a predetermined combination of marks provided in outer peripheral surfaces of the dial disks; and a locking member for preventing the door handle from being pulled out of the base body is driven through an unlocking operation of the combination lock.

In accordance with a second aspect of the present invention, the above object of the present invention is accomplished by providing:

In a door locking handle assembly provided with a base body which is fixedly mounted on a door, wherein a door handle is pivoted to the base body so as to be capable of being pulled out and pushed down relative to the base body and also turning on its pivoted end, wherein a lock plate directly or indirectly connected with the door handle is disengaged from a receiving portion of a stationary frame element such as a main body of a box when the door handle is pulled out and turned or turned after its pulling-out operation, the improvement wherein:

a combination lock, which is provided with a plurality of marked dial disks, is incorporated in either the door handle or the base body and opened by turning each of the marked dial disks a given number of times to establish a predetermined combination of marks provided in outer peripheral surfaces of the dial disks; and a cylinder lock for preventing the door handle from being pulled out of the base body is incorporated in the door handle to have its locking member prevented from moving in its unlocking direction by the combination lock.

In the door locking handle assembly according to the first aspect of the present invention, a control operator of the instruments housed in the box allocates to each of a large number of eligible users a unique combination of marks of the marked dial discs of the combination lock for unlocking the lock.

Each of the eligible user is capable of unlocking the combination lock of the door locking handle assembly of the present invention by turning in a normal or a reverse direction each of the marked dial discs a given number of times to establish the above unique combination allocated to each user, wherein the marks are provided in an outer peripheral surface of each of the dial discs.

When the unique combination is established, the combination lock is capable of moving to its unlocking position.

Through this movement to the unlocking position of the combination lock, the locking member is moved to its unlocking position. Due to this, the door handle is released from the base body of the assembly to move to its pulled-up or inclined position.

When the door handle is pulled out of the base body or turned on its pivoted end after its pulling-out operation, the lock plate directly or indirectly connected with the door handle is disengaged from the receiving portion of the main body of the box containing the instruments therein, which permits the door of the box to be opened.

In the door locking handle assembly according to the second aspect of the present invention, a control operator allocates a unique combination of marks of the dial discs of the combination lock to each of a large number of eligible users of the instruments contained in the box.

In case that each of the eligible users opens the door of the box to use the instruments contained in the box, each of the users is capable of unlocking the combination lock of the door locking handle assembly of the present invention by turning in a normal or a reverse direction each of the marked dial discs a given number of times to establish the above unique combination allocated to each user, wherein the marks are provided in an outer peripheral surface of each of the dial discs.

When the unique combination is established, the combination lock is capable of moving to its unlocking position. Through this movement to the unlocking position of the combination lock, the locking member is moved to its unlocking position. Due to this, the door handle is released from the base body of the assembly to move to its pulled-up or inclined position.

When the door handle is pulled out of the base body or turned on its pivoted end after its pulling-out operation, the lock plate directly or indirectly connected with the door handle is disengaged from the receiving portion of the main body of the box containing the instruments therein, which permits the door of the box to be opened.

BRIEF DESCRIPTION OF THE DRAWINGS

The above and other objects, advantages and features of the present invention will be more apparent from the following description taken in conjunction with the accompanying drawings in which.

DETAILED DESCRIPTION OF THE PREFERRED EMBODIMENTS

The best modes for carrying out the present invention will be described in detail using embodiments of the present invention with reference to the accompanying drawings.

First Embodiment

Figure 4:
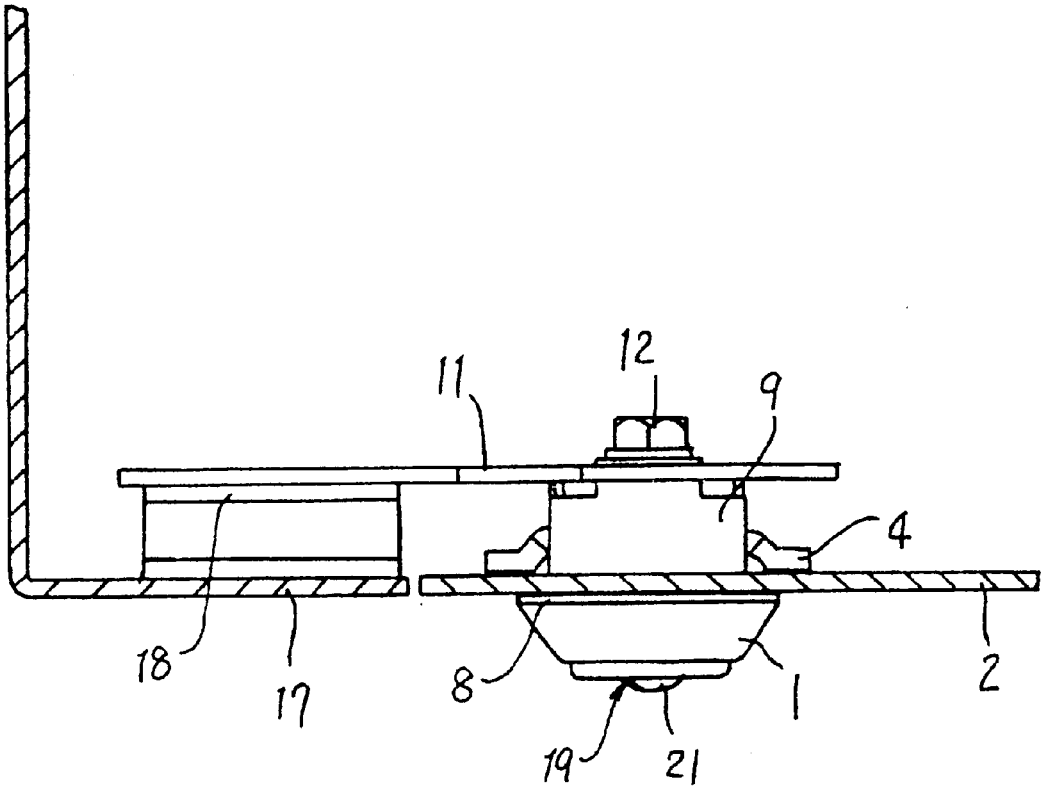
FIG. 4 is a plan view of the door locking handle assembly shown in FIG. 1.

A first embodiment of a door locking handle assembly according to the first aspect of the present invention is shown in FIGS. 1 to 13. In this first embodiment, a base body 1 is mounted in a mounting hole 3 of a door 2 from a rear surface of the door 2 in an insertion manner, and firmly fixed to the door 2 through a washer plate 4 (shown in FIG. 4) and a plurality of screws 7 (FIG. 5) in this order by fastening the screws 7 so as to be threadably engaged with a threaded hole 6 of the base body 1. On the other hand, a packing member 8 is inserted into a clearance between a peripheral edge portion of the base body 1 and a front surface of the door 2. Formed in an upper portion of a rear surface of the base body 1 is a bearing sleeve portion 9 extending in a direction perpendicular to the front surface of the base body 1. Rotatably inserted in this bearing sleeve portion 9 of the base body 1 is a locking shaft 10 which is prevented from axially moving relative to the base body 1. The locking shaft 10 is provided with a square bar portion in its rear end, on which a lock plate 11 is mounted and firmly fixed thereto by tightening a bolt 12 threadably engaged with the rear end portion of the locking shaft 10.

A fan-shaped concave portion 14 is formed in a rear surface of an upper end portion of the door handle 13. Rotatably mounted in this concave portion 14 in an insertion manner is a front end portion of the locking shaft 10, so that the door handle 13 has its rear end portion pivoted to the front end portion of the locking shaft to 10 through a cross pivot 15 extending in parallel with the front surface of the door 2. In operation, when the door handle 13 is pushed down into the base body 1, a main body of the door handle 13 is embedded in a front concave portion 16 of the base body 1. In this embedded condition, a lower end portion of the door handle 13 projects downward beyond a lower end portion of the base body 1 to form a finger engaging portion which is engageable with a finger of the user to facilitate the pulling-out operation of the door handle 13 relative to the base body 1.

When the door handle 13 is swingably pulled out of the base body 1 to reach its inclined position, it is easy for the user to turn the door handle 13 on its pivoted end. When the door handle 13 is turned, the locking shaft 10 is also turned together with the door handle 13 so that the lock plate 11 is disengaged from the receiving portion 18 of the stationary frame element 17 such as a main body of the box and like containers, whereby the door 2 is unlocked from the stationary frame element 17. Consequently, it is possible for the user to open the door by pulling the door handle 13 forward, which permits the user to have access to the instruments of the box and do maintenance of these instruments.

Figure 5:
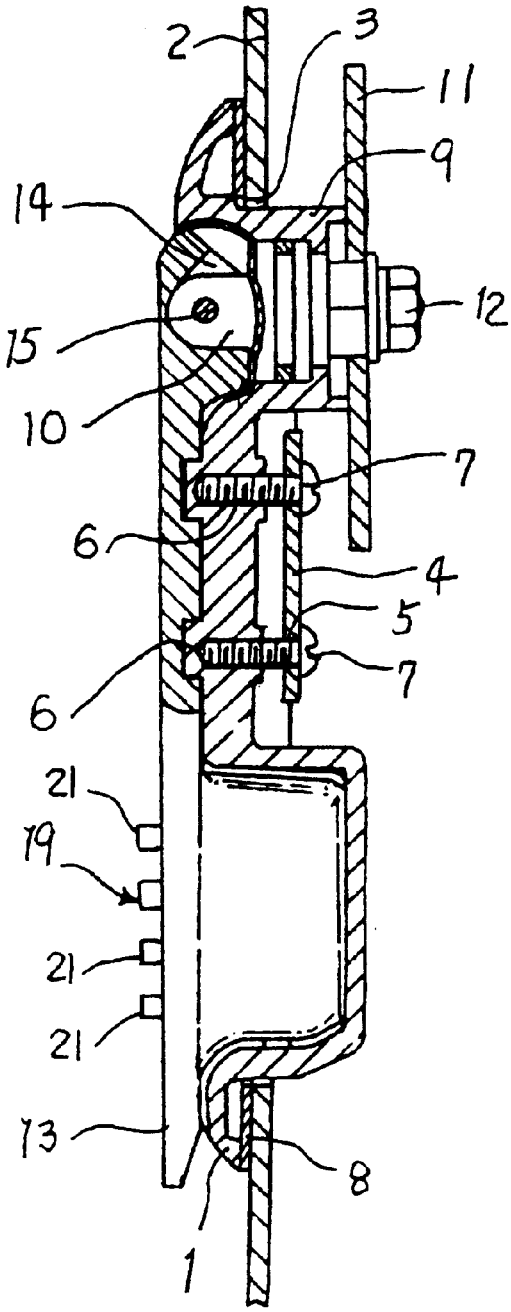
FIG. 5 is a longitudinal sectional view of the door locking handle assembly, taken along the line A—A of FIG. 1.

As shown in FIG. 5, a combination lock 19 is incorporated in a concave portion formed in a rear surface of a lower end portion of the door handle 13, wherein the concave portion is walled in by a thick wall portion of the door handle 13. Essential components of the combination lock 19 are arranged in a longitudinal direction of the door handle 13, and comprise: a support shaft 20 fixedly mounted in the door handle 13; a plurality of marked dial discs 21 and a plurality of cam discs 22 both rotatably mounted on the support shaft 20, wherein the marked dial discs 21 are spaced alternately with the cam discs 22 on the support shaft 20, and each of the dial discs 21 is provided with a plurality of marks in its outer peripheral surface; a compression coil spring 23 for axially biasing theses discs 22, 21 in this laminated state; and, a sliding plate 24 capable of abutting against or separating from the cam discs 22.

Figure 6:
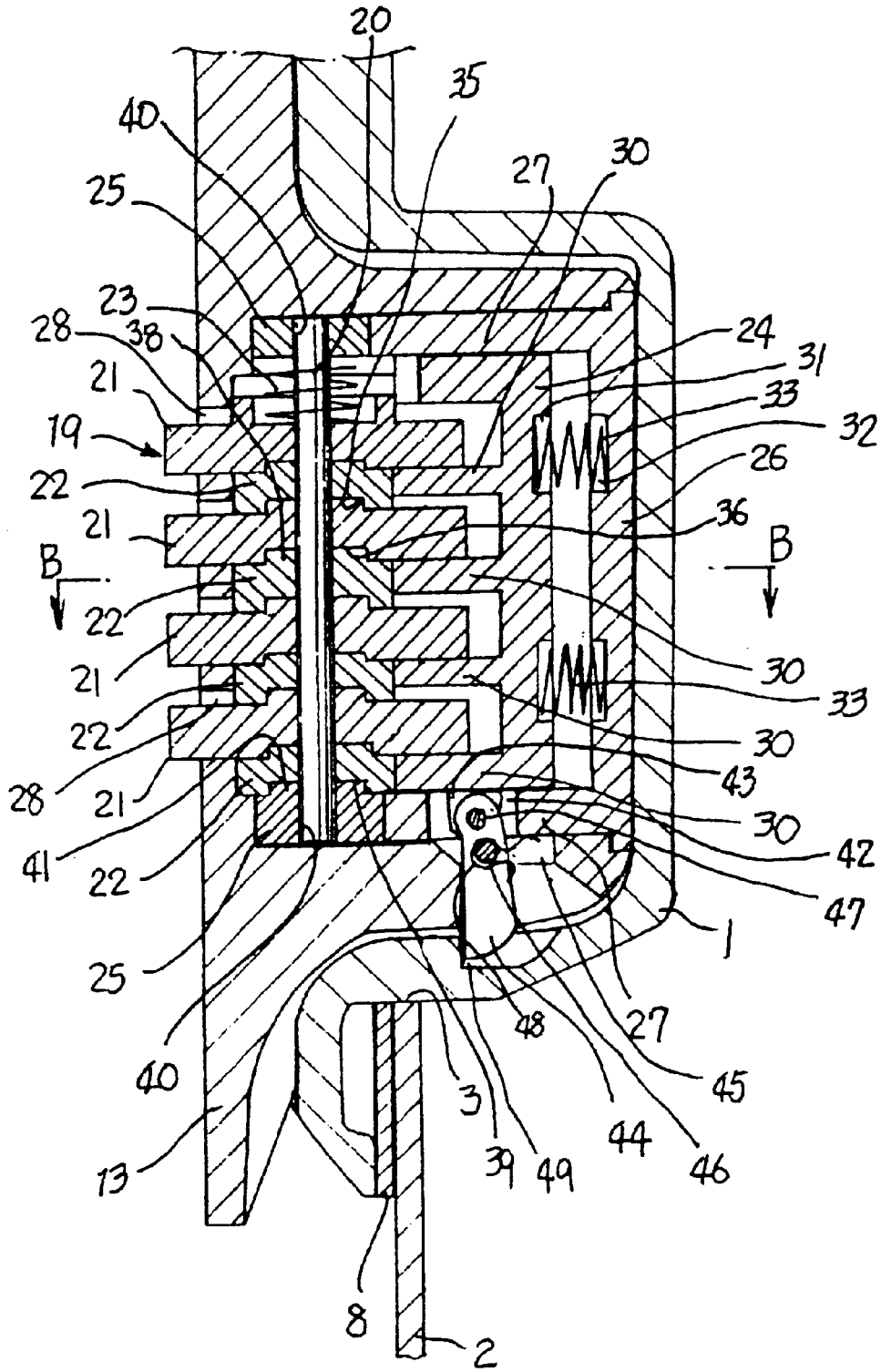
FIG. 6 is an enlarged longitudinal sectional view of the combination lock used in the door locking handle assembly shown in FIG. 1, illustrating the combination lock in its locked position.

Mounted on an upper and a lower end portion of the support shaft 20 in an insertion manner is an upper bearing disc 25 and a lower bearing disc 25', respectively (shown in FIG. 6). These bearing discs 25 and 25' are held in their predetermined fixed positions by means of an upper and a lower leg portion 27 of a spring supporting plate 26, respectively. This spring supporting plate 26 is fixedly mounted on the door handle 13 using suitable fastening means such as a screw or by staking. The above-mentioned compression coil spring 23 for keeping the discs 22, 21 in their laminated state is coaxially mounted on the support shaft 20 so as to surround the shaft 20 by itself, and sandwiched between the uppermost one of the dial discs 21 and the upper bearing disc 25.

In order to facilitate the user's reading the marks in the outer peripheral surface of each of the dial discs 21, and, further in order to facilitate the user's manipulation of these dial discs 21 by fingers when these discs 21 are rotated to establish the combination of the marks, a part of the outer peripheral portion of each of the dial discs 21 projects forward beyond the front surface of the door handle 13 through a slot 28 (shown in FIG. 6) formed in the front wall portion of the door handle 13. In this first embodiment of the door locking handle assembly, ten pieces of numerical symbols (from "0" to "9") are used as the marks of the dial discs 21, and spaced apart from each other at equal angular intervals.

Figure 8:
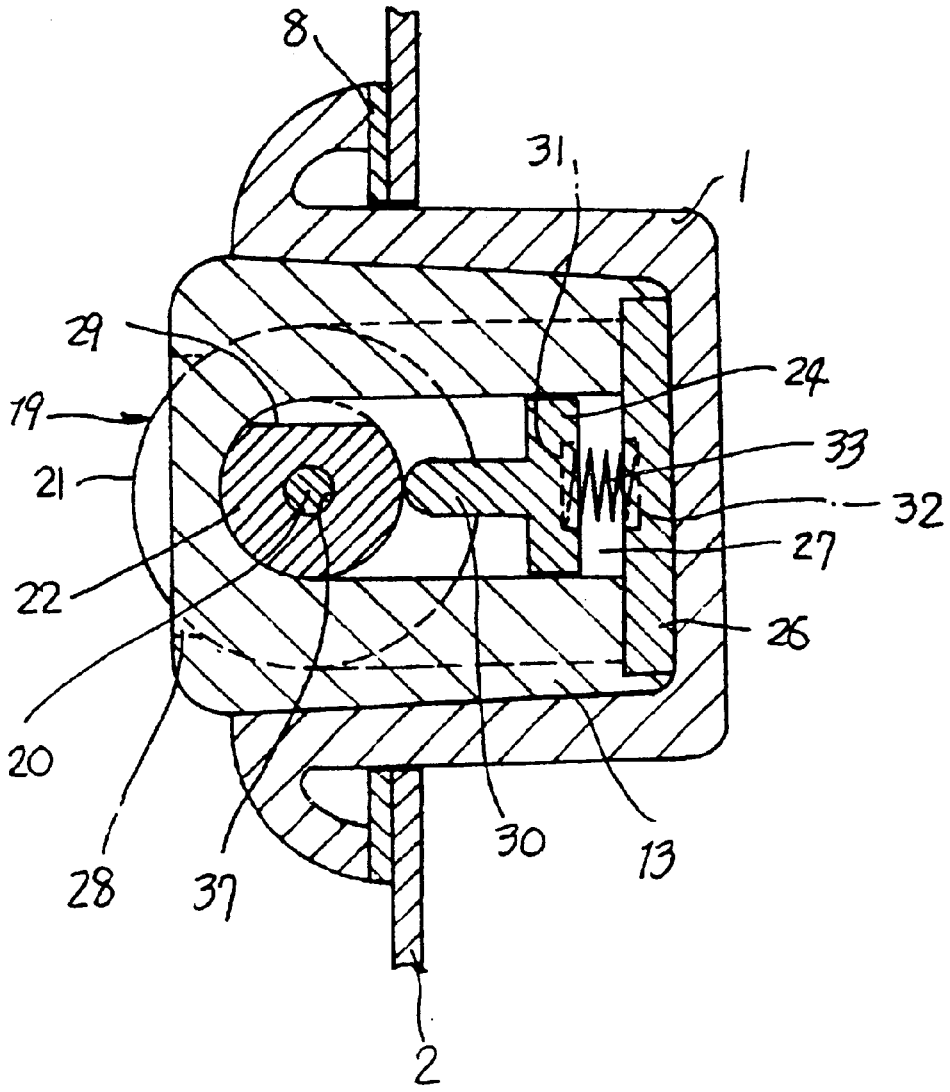
FIG. 8 is a cross-sectional view of the door locking handle assembly, taken along the line B—B of FIG. 6.
Figure 9:
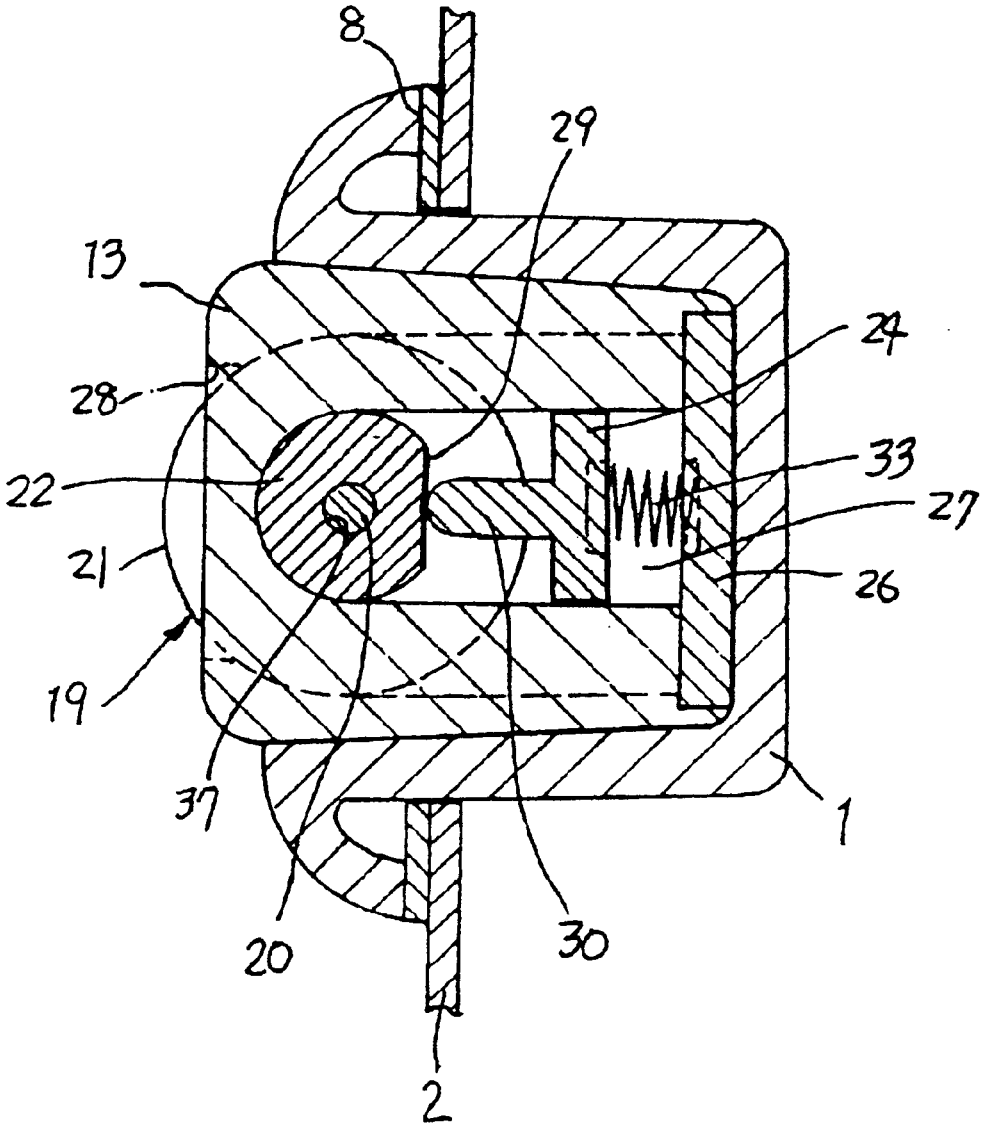
FIG. 9 is a cross-sectional view of the door locking handle assembly, taken along the line C—C of FIG. 7.

On the other hand, as shown in FIG. 8, the cam disc 22 is smaller in diameter than the dial disc 21, and has a part of its outer peripheral portion cut to form a flat surface portion 29, against which a rounded front end portion of a detecting plate portion 30 of the sliding plate 24 abuts, as shown in FIG. 9.

As is clear from FIG. 6, the sliding plate 24 including its detecting plate portion 30 assumes a comb-like shape as a whole. Formed in a rear surface of a main body portion of the sliding plate 24 are a plurality of spring support concave portions 31 which correspond in position to a plurality of another spring support concave portions 32, respectively, wherein the latter concave portions 32 are formed in a front surface of the spring supporting plate 26, as shown in FIG. 6. Consequently, the compression coil spring 33 has its opposite end portions supported by these concave portions 31, 32 to resiliently bias the sliding plate 24 leftward as viewed in FIG. 6, i.e., toward their laminated body (21, 22) constructed of both the dial discs 21 and the cam discs 22.

Figure 10:
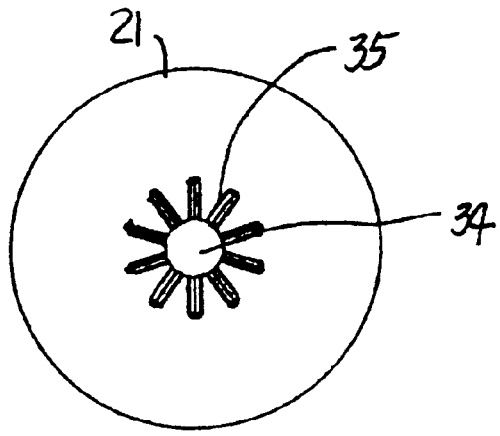
FIG. 10 is a plan view of a cam disk used in the combination lock of the door locking handle assembly shown in FIG. 1.
Figure 11:
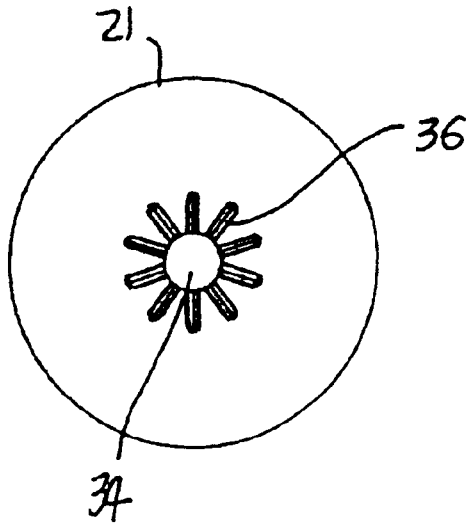
FIG. 11 is a bottom view of the cam disk shown in FIG. 10.

As shown in FIGS. 10 and 11, formed in an upper surface of the dial disc 21 are ten pieces of ribs 35, which extend radially outward from a center hole of the disc 21 and are spaced apart from each other at equal angular intervals. These ribs 35 correspond, respectively, in position to a plurality of receiving grooves 36 formed in a lower surface of the dial disc 21. Consequently, the number of the receiving grooves 36 is also ten in this embodiment. Incidentally, as for the uppermost one of the dial discs 21 in the laminated body (21, 22) shown in FIG. 6, no rib (35) is formed in an upper surface of the uppermost one of the dial discs 21.

Figure 12:
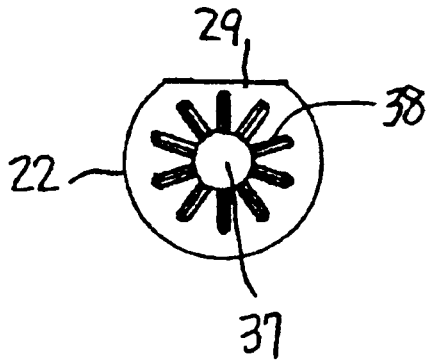
FIG. 12 is plan view of a dial disk used in the combination lock of the door locking handle assembly shown in FIG. 1.
Figure 13:
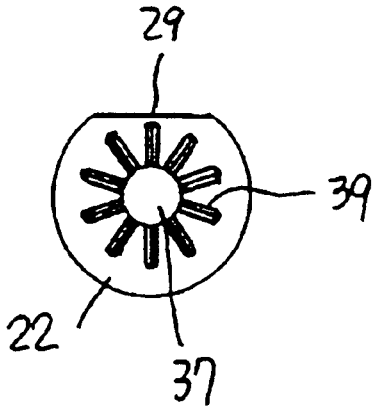
FIG. 13 is a bottom view of the dial disk shown in FIG. 12.

Further, as shown in FIGS. 12 and 13, formed in an upper surface of the cam disc 22 are ten pieces of ribs 38, which extend radially outward from a center hole of the disc 22 and are spaced apart from each other at equal angular intervals. These ribs 38 correspond, respectively, in position to a plurality of receiving grooves 39 formed in a lower surface of the cam disc 22. Consequently, the number of these receiving grooves 39 is also ten in this embodiment.

Furthermore, as shown in FIG. 6, formed in an upper surface of the lower bearing disc 25' are ten pieces of ribs 41, which radially extend outward from a center hole 40 (shown in FIG. 6) of the lower bearing disc 25' and are spaced apart from each other at equal angular intervals.

The cam disc 22 and the dial disc 21 disposed on the cam disc 22 are combined to form one of a plurality of combination setting elements. More particularly, in operation, the ribs 38 formed in an upper surface of the cam disc 22 are engaged with the receiving grooves 36 of the lower surface of the dial disc 21. This engagement is maintained under the influence of a basing force exerted by the compression coil spring 23, so that the above-mentioned combination setting elements are kept in their initially set positions.

In order to change the combination setting elements in their set positions, it is necessary to axially move the dial disc 21 against a resilient force exerted by the compression coil spring 23. Such an axial movement of the dial disc 21 permits the thus moved dial disc 21 to rotate through a predetermined angle. After such rotation of the dial disc 21, the dial disc 21 is moved toward the cam disc 22 to have the ribs 38 of the cam disc 22 engaged again with the receiving grooves 36 of the dial disc 21.

In changing the combination a setting elements (21, 22) in setting, in order to prevent the cam discs 22 from deviating from their original reference positions, the lowermost one of the cam discs 22 has the receiving grooves 39 of its lower surface engaged with the ribs 41 of the upper surface of the lower bearing disc 25'. Further, the second one of the cam discs 22 as counted from the bottom of the laminated body (21, 22) has the receiving grooves 39 of its lower surface engaged with the ribs 35 of the upper surface of the dial disc 21 adjacent to the second one of the cam discs 22. As for the third one of the cam discs 22 as counted from the bottom of the laminated body (21, 22) has the receiving grooves 39 of its lower surface engaged with the ribs 35 of the upper surface of the dial disc 21 adjacent to the third one of the cam discs 22. In this manner and sequence, each of the remaining cam discs 22 subsequent to the third one 22 has the receiving grooves 39 of its lower surface engaged with the ribs 35 of the upper surface of the dial disc 21 adjacent to each cam disc 22.

Figure 7:
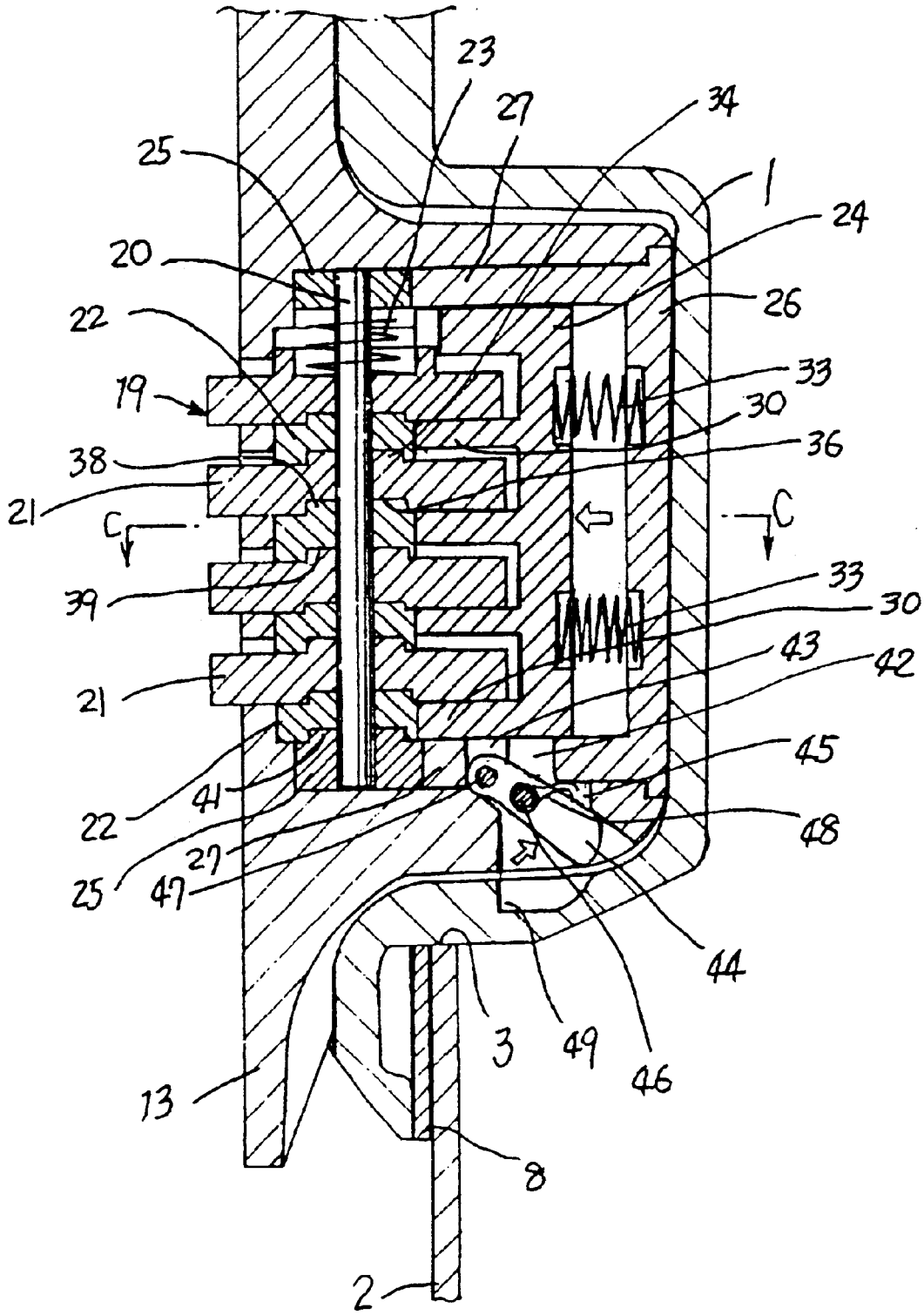
FIG. 7 is an enlarged longitudinal sectional view of the combination lock used in the door locking handle assembly shown in FIG. 1, illustrating the combination lock having been moved to its unlocked position.

As is clear from FIG. 7, an opening or window 42 is formed in an intermediate area of the lower leg portion 27 of the spring supporting plate 26. Formed in the lowermost one of the detecting plate portions 30 of the sliding plate 24 is an interlocking projection 43 which is inserted into the window 42 of the lower leg portion 27 of the spring supporting plate 26 so as to be movable right and left as viewed in FIGS. 6 and 7. On the other hand, a locking member 44 for preventing the door handle 13 from being pulled out of the base body 1 is of a rotary latch type. This locking member 44 is received in a hollow portion 45 of the door handle 13, and pivoted to an inner wall of the hollow portion 45 through a pivot 46 extending in parallel with a front surface of the door 2. Further, the locking member 44 has its upper end portion connected with the interlocking projection 43 of the sliding plate 24 through a connecting pin 47. This connecting pin 47 is loosely fitted in pin receiving holes each formed in each of the locking member 44 and the interlocking projection 43 of the sliding plate 24, which permits the locking member 44 to easily rotate on the pivot 46. This pivot 46 passes through a hollow coiled portion of a torsion spring 48 to permit the torsion spring 48 to be mounted on the pivot 46. The torsion spring 48 has one of its opposite linear free end portions abut against the leg portion 27 of the spring supporting plate 26 and the other of its opposite free end portions abut against a side surface of the locking member 44, so that the locking member 44 has its front end portion resiliently biased toward a receiving portion 49 (see a lower part of FIG. 7) of the base body 1 to have the same front end portion abut against the receiving portion 49.

Figure 1:
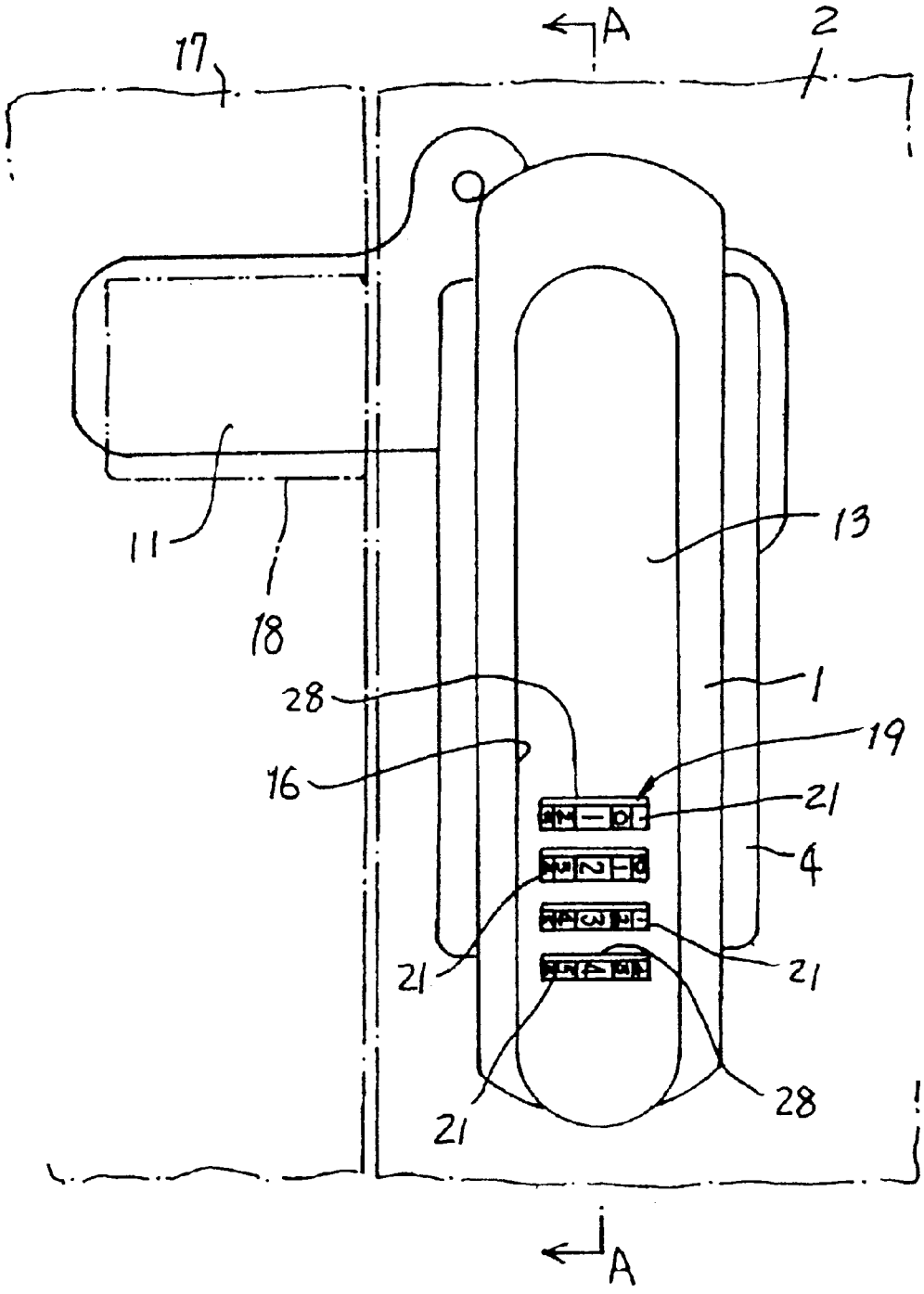
FIG. 1 is a front view of an embodiment of the door locking handle assembly according to the first aspect of the present invention.
Figure 2:
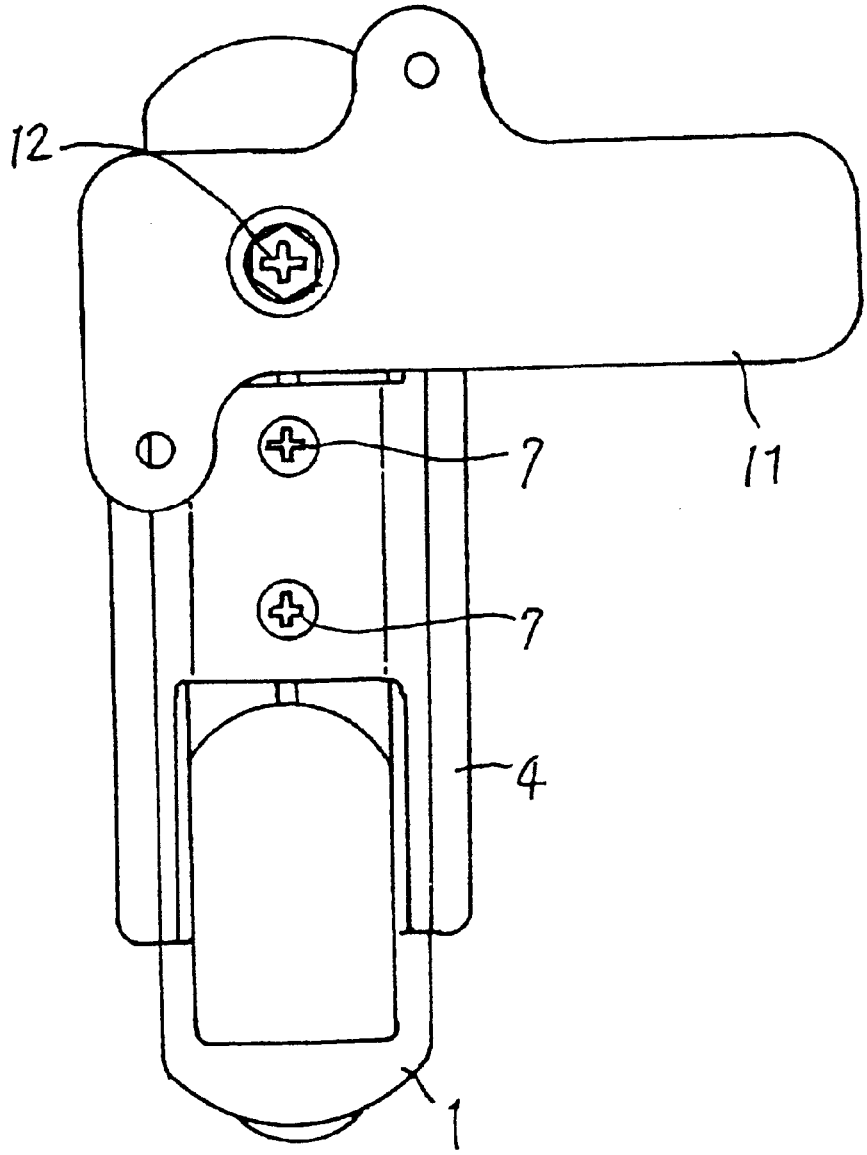
FIG. 2 is a rear view of the door locking handle assembly shown in FIG. 1.
Figure 3:
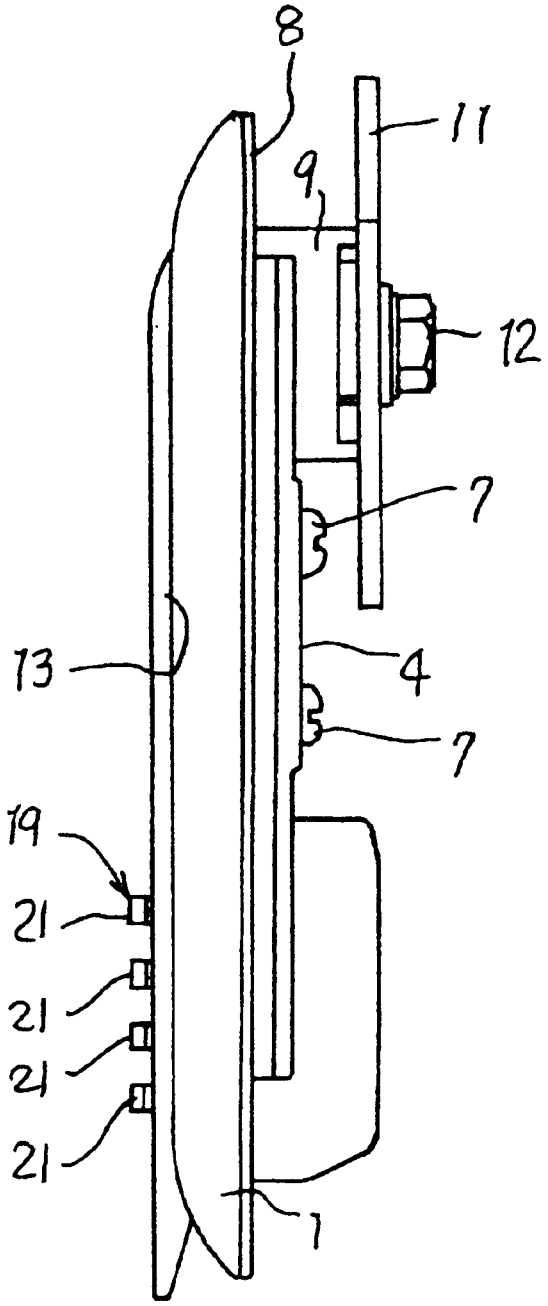
FIG. 3 is a right side view of the door locking handle assembly shown in FIG. 2.

As shown in FIG. 1, in a condition in which the door 2 is locked, the door handle 13 (shown in FIG. 5) is pushed down so as to be embedded in the base body 1. In other words, in a condition shown in FIG. 5, the door handle 13 is fully received in the front concave portion 16 (shown in FIG. 1) of the base body 1. In a condition in which the door 2 is locked (see FIGS. 6 and 8), the combination lock 19 has an outer peripheral surface of each of its cam discs 22 abut against the detecting plate portion 30 of the sliding plate 24. Due to this, as is clear from FIG. 8, the sliding plate 24 is disposed in its most retracted position in this condition, so that a lower free end portion of the locking member 44 abuts against the receiving portion 49 of the base body 1 as shown in FIG. 6.

In the above condition, even when a person not legally authorized to have access to the instruments of the box tries to pull the door handle 13 out of the front concave portion 16 of the base body 1 by catching and pulling forward the lower end portion of the door handle 13 with his or her finger in order to have the door handle 13 rotated on the cross pivot 15 and assume its pulled-up position, a pulling force applied by the illegal person to the lower end portion of the door handle 13 eventually acts on the sliding plate 24 through the locking member 44 so as to move forward or advance the detecting plate portion 30 of the sliding plate 24. In this condition, however, the front end of the detecting plate portion 30 of the sliding plate 24 has been already engaged with the outer circular peripheral surface portion of the cam disc 22 to prevent the sliding plate 24 from further advancing, which prevents the locking member 44 from rotating counterclockwise on its pivot 46 and unlocks the door handle 13 from the base body 1, as shown in FIG. 8. Due to this, such illegal person fails to unlock the door handle 13 from the base body 1.

In contrast with this, when the eligible user having his allocated unique combination of the marks of the dial discs 21 of the combination lock 19 establishes such unique combination by properly turning each of the four dial discs 21 (shown in FIG. 6) in the normal or the reverse direction of rotation, the cam discs 22 having been interlocked with the dial discs 21 have their flat surface portions 29 abut against the detecting plate portions 30 of the sliding plate 24, as shown in FIG. 9.

When the detecting plate portion 30 of the sliding plate 24 has its contact point transferred from a circular peripheral surface portion of the cam disc 22 to the flat surface portion 29 of the same cam disc 22, the sliding plate 24 is advanced forward under the influence of a resilient force exerted by each of the compression coil springs 33, as shown in FIGS. 7 and 9. Such advancing motion of this sliding plate 24 causes the locking member 44 to rotate counterclockwise on the pivot 46 against a resilient force exerted by the torsion spring 48. Due to this, as shown in FIG. 7, the lower free end portion of the locking member 44 is released from the receiving portion 49 of the base body 1 to enter a hollow portion of the door handle 13.

As a result, the door handle 13 is entirely unlocked from the base body 1, and rotates on the cross pivot 15 to reach its pulled-up position. When the door handle 13 is swingably pulled up relative to the base body 1 to rotate on the cross pivot 15, the door 2 is unlocked from the stationary frame element 17 and opened.

After completion of maintenance services of the instruments of the box, the door 2 is closed by pushing down the free end portion of the door handle 13 relative to the base body 1 so as to rotate counterclockwise the door handle 13 on its cross pivot 15, as viewed in FIG. 5. In this locking operation of the door 2, the lock plate 11 is engaged again with the receiving portion 18 of the stationary frame element 17, as shown in FIG. 1 in phantom lines. After that, in order to conceal the thus established unique combination of the marks of the dial discs 21 from the illegal person, at least one of the four pieces of the dial discs 21 is rotated in the normal or the reverse direction of rotation to break such unique combination of the marks established by the eligible user of the instruments of the box. In this concealing operation of the combination of the marks, each of the cam discs 22 mechanically interlocked with the dial discs 21 is rotated to have its circular outer peripheral surface portion abut against the detecting plate portion 30 of the sliding plate 24 in its diametrical direction, as is clear from FIG. 8.

As described above, when the contact point of the detecting plate portion 30 of the sliding plate 24 is transferred from the flat surface portion 29 of the cam disc 22 to the circular outer peripheral surface portion of the same cam disc 22, the sliding plate 24 is moved to its most retracted position shown in FIG. 6 against a resilient force exerted by the compression coil spring 33. Such retracting movement of the sliding plate 24 causes the locking member 44 to rotate clockwise on the pivot 46 under the influence of a resilient force exerted by the torsion spring 48, so that the lower free end potion of the locking member 44 abuts against the receiving portion 49 of the base body 1 to lock the door handle 13 to the base body 1, as shown in FIG. 6.

Figure 14:
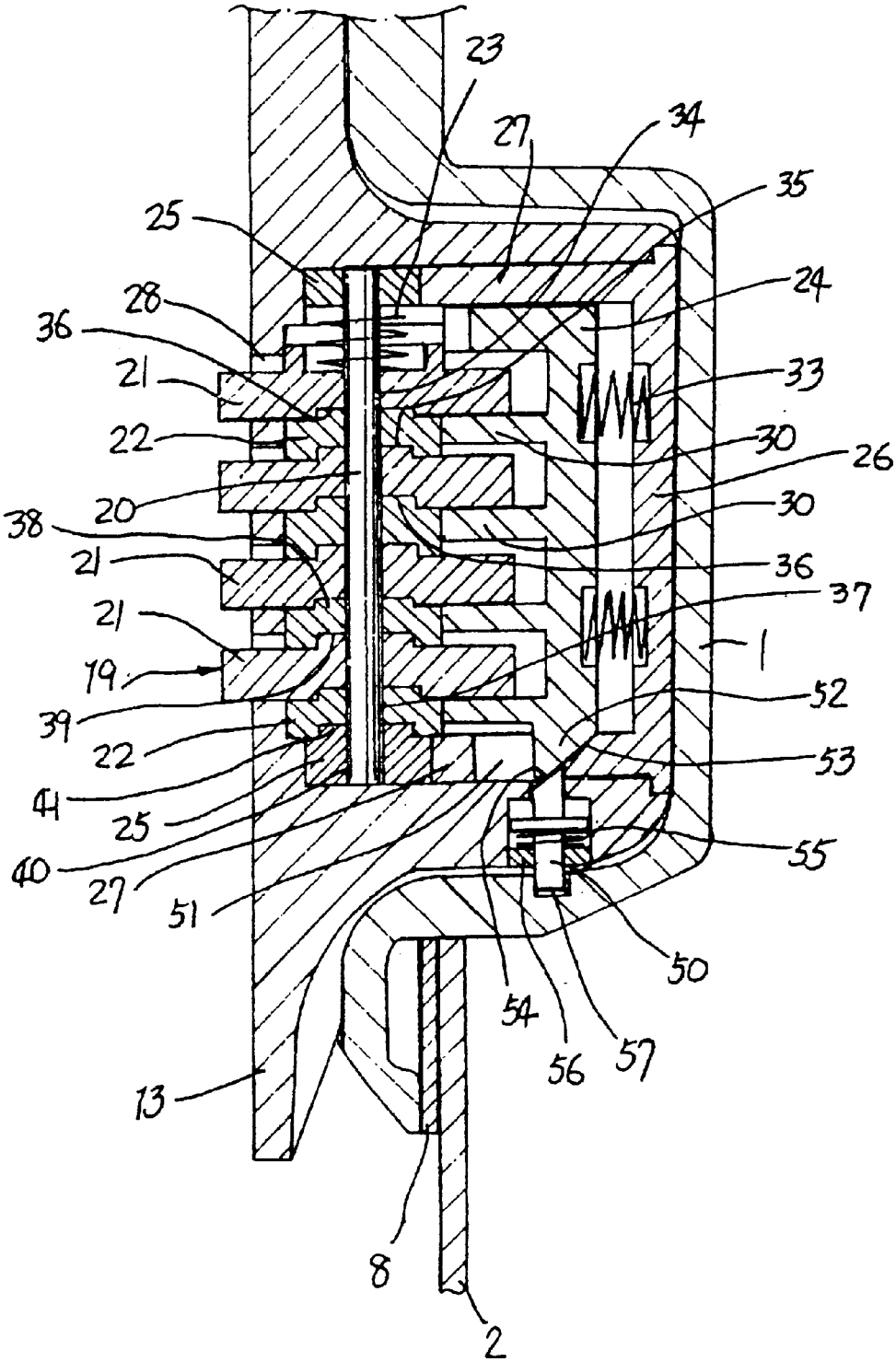
FIG. 14 is an enlarged longitudinal sectional view of another embodiment of the door locking handle assembly according to the first aspect of the present invention, illustrating the combination lock in its locked condition.

FIG. 14 is an enlarged longitudinal sectional view of another embodiment of the door locking handle assembly according to the first aspect of the present invention, illustrating the combination lock 19 in its locked condition. In this embodiment, its locking member 50 serves to lock the door handle 13 to the base body 1 and is constructed of a dead bolt which is movably mounted in the door handle 13 to as to be axially slidable in parallel with a longitudinal direction of the door handle 13. The locking member 50 is provided with a large-diameter portion in its intermediate portion.

As is clear from FIG. 14, the lower leg portion 27 of the spring supporting plate 26 is provided with its window 51 in an intermediate portion thereof. On the other hand, the lowermost detecting plate portion 30 of the sliding plate 24 is provided with an interlocking projection 52. This projection 52 extends downward from a lower surface of the lowermost detecting plate portion 30 of the sliding plate 24 to loosely fit in the window 51 of the spring supporting plate 26 so as to be movable up and down, as viewed in FIG. 14. The interlocking projection 52 of the sliding plate 24 is provided with a drive cam surface 53 which is inclined downward toward the locking member 50. Formed in an upper end portion of this locking member 50 is a driven cam surface 54, which is inclined upward toward the drive cam surface 53 of the sliding plate 24 to slidably engage with this drive cam surface 53. As shown in FIG. 14, the locking member 50 is resiliently biased upward toward the sliding plate 24 by a compression coil spring 55, which is mounted on a lower portion of the locking member 50 so as to loosely surround this lower portion between the large-diameter portion of the locking member 50 and a spring supporting seat 56 loosely fitted to the lower portion of the locking member 50. In this embodiment, the spring supporting seat 56 tightly fits in a lower end portion of the door handle 13 to axially guide the locking member 50 therein.

As for the remaining parts of the embodiment shown in FIG. 14, there is substantially no difference in construction between this second embodiment shown in FIG. 14 and the first embodiment shown in FIGS. 1 to 13. Consequently, in order to avoid redundancy in description, the description of the remaining parts of the second embodiment of FIG. 14 will be omitted.

In the second embodiment shown in FIG. 14, in a condition in which the door 2 is locked, the door handle 13 is pushed down into the base body 1 so as to be received in the front concave portion 16 of the base body 1. In this condition, the detecting plate portion 30 of the sliding plate 24 abuts against the circular peripheral surface portion of the cam disc 22 of the combination lock 19. Due to this, the sliding plate 24 assumes its most retracted position as shown in FIG. 14, so that the locking member 50 has its lower end portion engaged with a receiving portion 57 of the base body 1.

In the above condition, even when a person, who is not legally authorized and therefore has no idea of the combination of the marks of the combination lock 19 to have access to the instruments of the box tries to pull the door handle 13 out of the front concave portion 16 of the base body 1 by catching and pulling forward the lower end portion of the door handle 13 with his or her finger in order to have the door handle 13 rotated on the cross pivot 15 and assume its pulled-up position, the locking member 50 constructed of the dead bolt prevents the door handle 13 from being pulled out of the front concave portion 16 of the base body 1 since the locking member 50 lower end portion abuts against an inner peripheral wall of the receiving portion 57 of the base body 1 to keep the locked condition of the door handle 13.

In contrast with this, when the eligible user having his allocated unique combination of the marks of the dial discs 21 of the combination lock 19 establishes such unique combination by properly turning each of the four dial discs 21 (shown in FIG. 6) in the normal or the reverse direction of rotation, the cam discs 22 having been interlocked with the dial discs 21 have their flat surface portions 29 abut against the detecting plate portions 30 of the sliding plate 24, as shown in FIG. 9.

When the detecting plate portion 30 of the sliding plate 24 has its contact point transferred from a circular peripheral surface portion of the cam disc 22 to the flat surface portion 29 of the same cam disc 22, the sliding plate 24 is advanced forward under the influence of a resilient force exerted by each of the compression coil springs 33, as shown in FIGS. 7 and 9. Such advancing motion of the sliding plate 24 permits the locking member 50 to move upward under the influence of a resilient force exerted by the compression coil spring 55, so that the locking member 50 is released from the receiving portion 57 of the base body 1 and embedded in the door handle 13.

As a result, the door handles 13 having been released from the base body 1 is capable of being rotated on its cross pivot 15 in this condition. After that, when the door handle 13 is swung or turned on the locking shaft 10 in a plane parallel to the front surface of the door 2, the door 2 is unlocked from the stationary frame element 17 and opened.

After completion of maintenance services of the instruments contained in the box, the door 2 is closed by pushing down the free end portion of the door handle 13 relative to the base body 1 so as to rotate counterclockwise the door handle 13 on its cross pivot 15, as viewed in FIG. 5. In this locking operation of the door 2 to the stationary frame element 17, the lock plate 11 is engaged again with the receiving portion 18 of the stationary frame element 17 so that the door 2 is locked to the stationary frame element 17. Then, the door handle 13 is pushed down so as to be embedded in the base body 1. After that, in order to conceal the thus established unique combination of the marks of the dial discs 21 from the illegal person, at least one of the four pieces of the dial discs 21 is rotated in the normal or the reverse direction of rotation to break such unique combination of the marks established by the eligible user of the instruments contained in the box. In this concealing operation of the combination of the marks, each of the cam discs 22 mechanically interlocked with the dial discs 21 is rotated to have its circular outer peripheral surface portion abut against the detecting plate portion 30 of the sliding plate 24 in its diametrical direction, as is clear from FIG. 8.

As described above, when the contact point of the detecting plate portion 30 of the sliding plate 24 is transferred from the flat surface portion 29 of the cam disc 22 to the circular outer peripheral surface portion of the same cam disc 22, the sliding plate 24 is moved to its most retracted position shown in FIG. 6 against a resilient force exerted by the compression coil spring 33. Such retracting movement of the sliding plate 24 causes the locking member 50 to move downward since the drive cam surface 53 of the interlocking projection 52 of the sliding plate 24 is brought into slidable contact with the driven cam surface 54 of the locking member 50 to urge the latter downward. As a result, as shown in FIG. 14, the front end portion of the locking member 50 is received in the receiving portion 57 of the base body 1 so that the door handle 13 is locked again to the base body 1.

Figure 15:
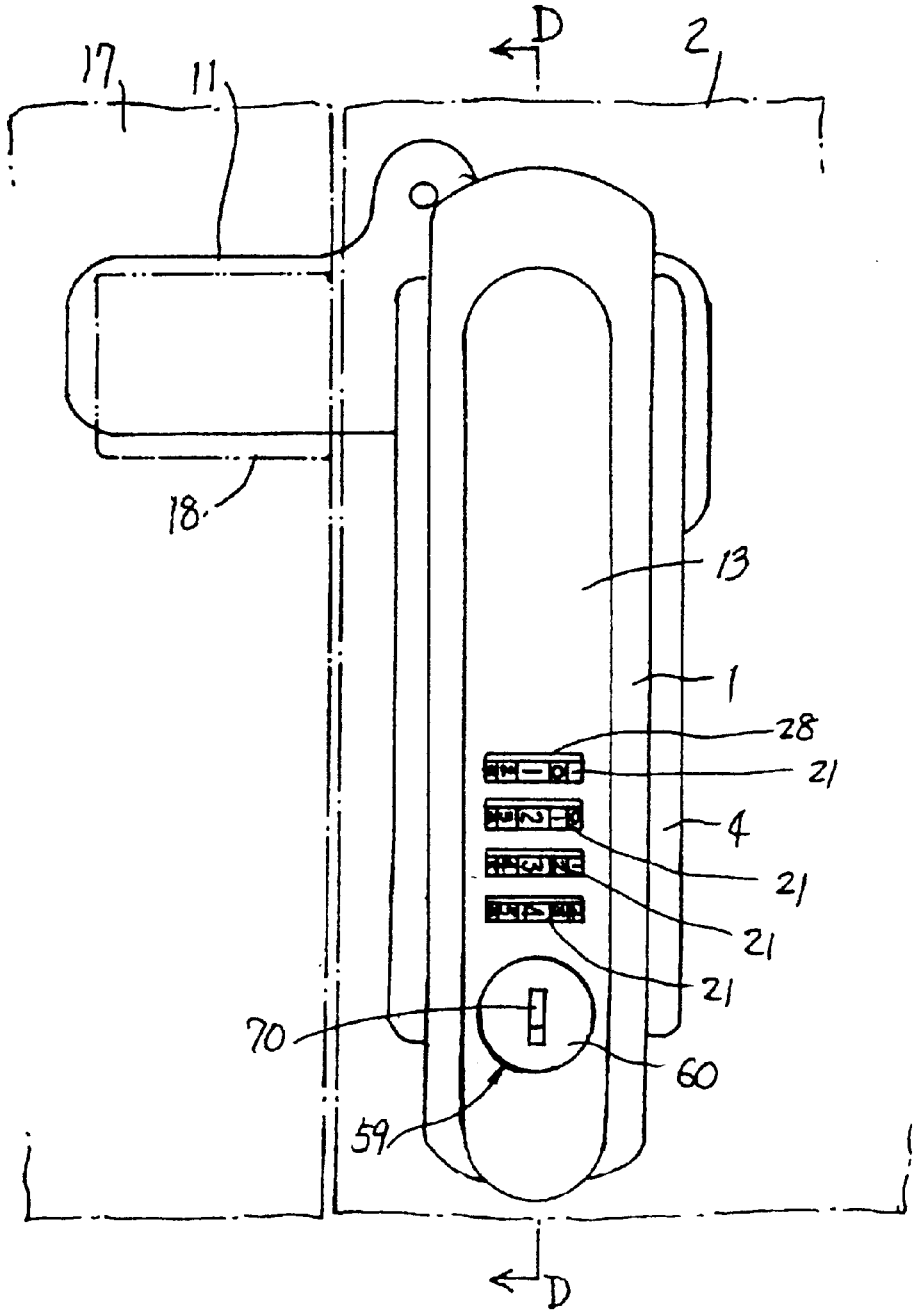
FIG. 15 is a front view of an embodiment of the door locking handle assembly according to the second aspect of the present invention.
Figure 16:
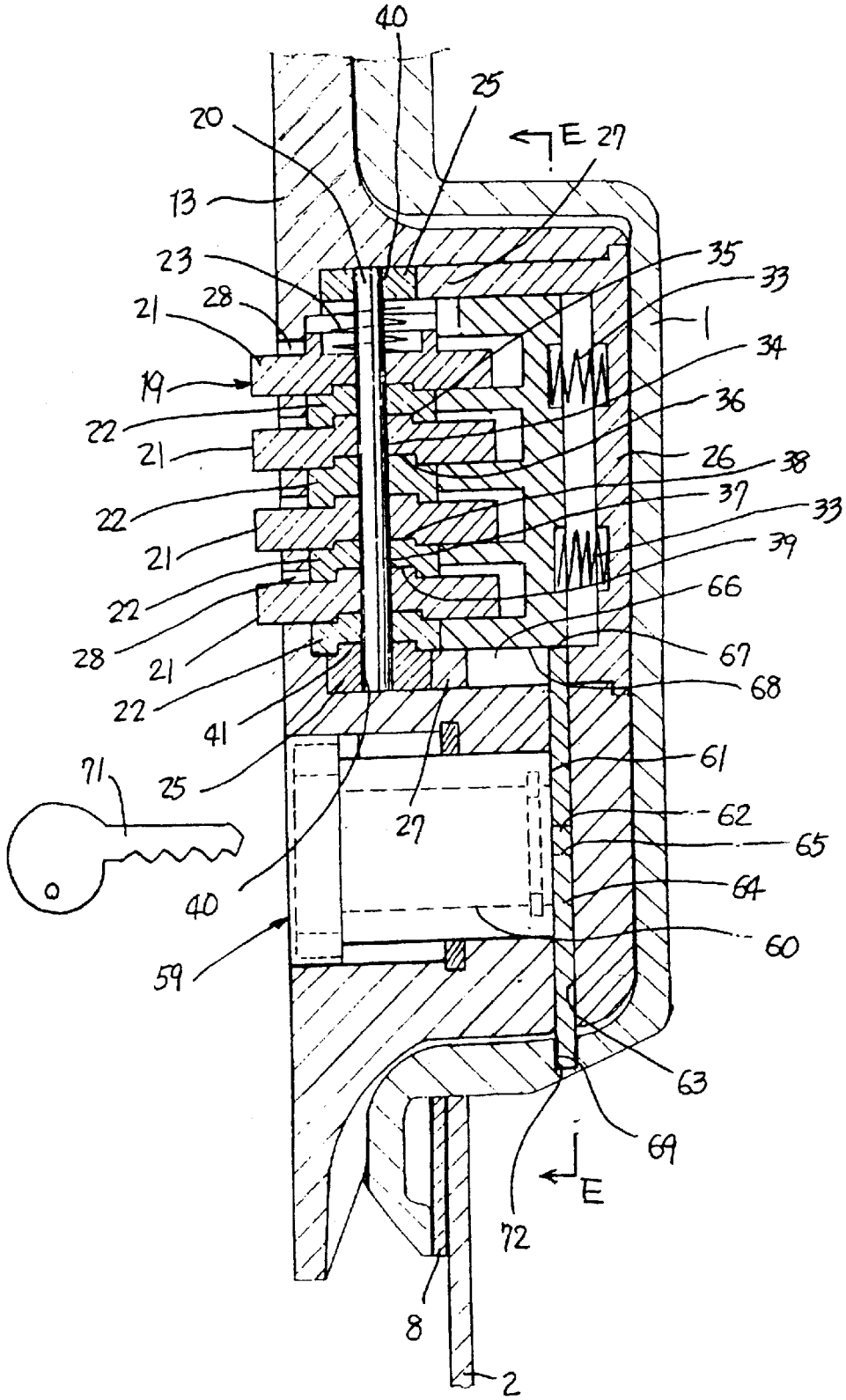
FIG. 16 is a longitudinal sectional view of the door locking handle assembly, taken along the line D—D of FIG. 15 to illustrate the combination lock in its locked condition.
Figure 17:
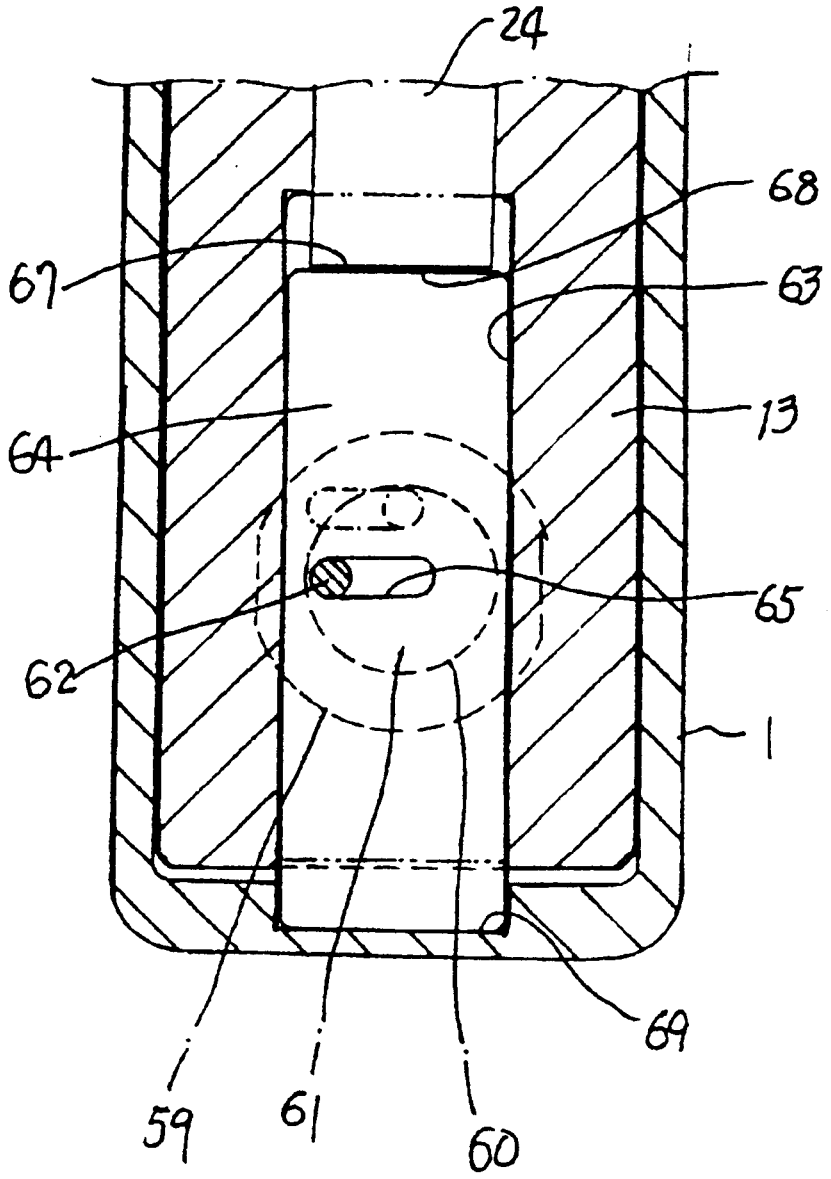
FIG. 17 is a longitudinal sectional view of the door locking handle assembly, taken along the line E—E of FIG. 16.

FIGS. 15 to 17 show an embodiment of the door locking handle assembly according to the second aspect of the present invention, in which a cylinder lock 59 is incorporated in the door handle 13 together with the combination lock 19.

As shown in FIG. 16, the cylinder lock 59 is provided with its internal lock mechanism in which: a conventional pin tumbler lock mechanism is used; and, a cam projection 62 is formed in a rear end surface 61 of a rotor 60 of the cylinder lock 59 and deviated in position from a rotation center of the rotor 60. A guide groove 63 is formed in the door handle 13 to extend in a longitudinal direction of the door handle 13 and slidably receives therein a locking member 64. This locking member 64 assumes an elongated flat plate-like shape and serves as a dead bolt.

The locking member 64 is provided with an elongated slot 65 in its intermediate portion. This slot 65 extends in the direction of the width of the locking member 64 and engages with the cam projection 62 of the rotor 60.

A window 66 is formed in an intermediate portion of the lower leg portion 27 of the spring supporting plate 26 to receive therein the locking member 64. An upper end surface 67 of the locking member 64 thus received in the window 66 abuts against a lower end surface 68 of the sliding plate 24. In this construction, as is clear from FIG. 16, the window 66 is much larger in thickness or depth than the locking member 64 to ensure that the locking member 64 does not interfere with the sliding plate 24 in its advancing and retracting operations. In this condition, as shown in FIG. 16, the lower end portion of the locking member 64 is brought into contact with a receiving potion 69 formed in the base body 1.

As for the remaining parts of this embodiment shown in FIG. 16, there is substantially no difference in construction between this embodiment shown in FIG. 16 and the first embodiment shown in FIGS. 1 to 14. Consequently, in order to avoid redundancy in description, the description of the remaining parts of this embodiment of FIG. 16 will be omitted.

In the embodiment shown in FIG. 15, in a condition in which the door 2 is locked, the door handle 13 is pushed down into the base body 1 so as to be received in the front concave portion 16 of the base body 1. In this condition, the detecting plate portion 30 of the sliding plate 24 abuts against the circular peripheral surface portion of the cam disc 22 of the combination lock 19 in a diametrical direction of the cam disc 22. Due to this, the sliding plate 24 assumes its most retracted position, so that the locking member 66 has its upper end surface 67 engaged with a lower end surface 68 of the sliding plate 24.

Consequently, in this condition, even when a person, who is not legally authorized and therefore has no idea of the combination of the marks of the combination lock 19 to have access to the instruments of the box tries to unlock the cylinder lock 59 using a proper key 71 inserted into a keyhole 70 of the rotor 60 of the cylinder lock 59, the rotor 60 can't be rotated by the key 71 since the locking member 64 is prevented from moving upward by the bottom surface of the sliding plate 24, as is clear from FIG. 15. Further, in this condition, even when the illegal person tries to pull the door handle 13 out of the front concave portion 16 of the base body 1, it is not possible for such illegal person to pull the door handle 13 out of the base body 1 since the locking member 64 has its lower end portion abut against an inner wall surface 72 of the receiving portion 69 of the base body 1 to prevent the door handle 13 from releasing from the base body 1, as shown in FIG. 16.

In contrast with this, when the eligible user having his allocated unique combination of the marks of the dial discs 21 of the combination lock 19 establishes such unique combination by properly turning each of the four dial discs 21 (shown in FIG. 6) in the normal or the reverse direction of rotation, the cam discs 22 having been interlocked with the dial discs 21 have their flat surface portions 29 abut against the detecting plate portions 30 of the sliding plate 24, as shown in FIG. 9.

When the detecting plate portion 30 of the sliding plate 24 has its contact point transferred from a circular peripheral surface portion of the cam disc 22 to the flat surface portion 29 of the same cam disc 22, the sliding plate 24 is advanced forward under the influence of a resilient force exerted by each of the compression coil springs 33, as shown in FIGS. 7 and 9. Such advancing motion of the sliding plate 24 permits the upper end surface 67 of the locking member 64 to be released from the bottom surface of the sliding plate 24. Due to this, when the rotor 60 of the cylinder lock 59 is rotated using such a proper key 71, the locking member 64 is driven upward since the cam projection 62 having been eccentrically arranged is slidably received in the slot 65 of the locking member 64, as shown in FIG. 17. The locking member 64 thus driven upward has its upper end portion received in a space disposed in the rear side of the sliding plate 24. As a result, the locking member 64 has its lower end portion fully released from the receiving portion 69 of the base body 1 to permit the door handle 13 to be unlocked from the base body 1. In this unlocking operation, the door handle 13 having been turned on the cross pivot 15 is then turned on the locking shaft 10, so that the lock plate 11 fixed to the door handle 13 is disengaged from the receiving portion 18 of the stationary frame element 17 to permit the door to be opened.

After completion of maintenance services of the instruments contained in the box, the door 2 is closed again. Then, the door handle 13 is turned on the locking shaft 10 in the reverse direction to have the lock plate 11 engaged again with the receiving portion 18 of the stationary frame element 17, so that the door 2 is locked to the stationary frame element 17. Then, the door handle 13 is pushed down so as to be embedded in the base body 1. After that, the rotor 60 of the cylinder lock 59 is rotated using the key 71 to move the locking member 64 downward through the engagement between the eccentric cam projection 62 of the rotor 60 and the slot 65 of the locking member 64, so that the lower end portion of the locking member 64 is engaged with the receiving portion 69 of the base body 1.

Then, in order to conceal the thus established unique combination of the marks of the dial discs 21 from the illegal person, at least one of the four pieces of the dial discs 21 is rotated in the normal or in the reverse direction of rotation to break such unique combination of the marks established by the eligible user of the instruments contained in the box. In this concealing operation of the combination of the marks, each of the cam discs 22 mechanically interlocked with the dial discs 21 is rotated to have its circular outer peripheral surface portion abut against the detecting plate portion 30 of the sliding plate 24 in its diametrical direction, as is clear from FIG. 8.

As described above, when the contact point of the detecting plate portion 30 of the sliding plate 24 is transferred from the flat surface portion 29 of the cam disc 22 to the circular outer peripheral surface portion of the same cam disc 22, the sliding plate 24 is moved to its most retracted position shown in FIG. 6 against a resilient force exerted by the compression coil spring 33. The sliding plate 24 thus retracted has the bottom surface 68 of its rear end portion abut again on the upper end surface 67 of the locking member 64.

As a result, the locking member 64 is kept in its lowermost position in which the lower end portion of the locking member 64 abuts against the receiving portion 69 of the base body 1, so that the door handle 13 is locked again to the base body 1.

In the above embodiments, though the lock plate 11 is indirectly connected with the door handle 13 through the locking shaft 10, it is also possible to have the door handle 13 directly connected with the lock plate 11 in an appropriate modification of the embodiments. In such a modification, for example: a base end portion of the door handle (13) is pivoted to the base body (1) through a cross pivot (15) extending in parallel to the front surface of the door (2); the lock plate (11) extending in a direction perpendicular to the front surface of the door (2) is pivoted to the rear surface of the base body (1); an operating lever extending from the rear surface of the base body (1) through an opening portion of a rear wall portion of the base body (1) is permitted to obliquely extend toward the base end portion of the door handle (13); and, the operating lever is inserted into a driven hole formed in the lock plate (11). In such a modification having the above construction: when the door handle (13) is pulled out and down relative to the base body (1), the operating lever has its side surface urge an inner wall surface of the driven hole of the locking plate (11) so that the lock plate (11) is transferred from its locked position to its unlocked position using the door handle (13) to directly rotate the lock plate (11).

As for the internal lock mechanism of the door locking handle assembly of the present invention, it is possible to employ any one of conventional mechanisms, for example such as disc tumbler mechanisms, pin tumbler mechanisms and the like. The gist of the present invention does not reside in such an internal lock mechanism. Therefore, the detailed description of such internal lock mechanism is omitted.

As for the locking member for locking the door handle to the base body, the locking member may be of any types in construction, for example such as a rotary latch type, a sliding latch type, a dead bolt type, or the like, and not restricted to those disclosed in the embodiments.

Further, it is also possible for the present invention to have the combination lock 19 and/or the cylinder lock 59 incorporated in the base body 1.

In the door locking handle assembly according to the first aspect of the present invention: the combination lock 19 may be incorporated in the door handle 13 and/or the base body 1; since the locking member for preventing the door handle 13 from assuming its pulled-up position relative to the base body 1 is driven when the combination lock 19 is unlocked, it is possible to considerably reduce in thickness the door locking handle assembly of the present invention as a whole in construction, which permits the combination lock of the assembly to have a very large number of eligible keys; and, the door locking handle assembly of the present invention permits, through a computerized personal management system of users, a plurality of eligible persons or users to have easily access to their instruments of the box provided with the door locking handle assembly of the present invention, without fail.

In the door locking handle assembly according to the second aspect of the present invention: only when the allocated unique combination of the marks of the dial discs of the combination lock 19 is established by the user, it is possible to unlock the combination lock 19 incorporated in the base body 1 and/or the door handle 13, while the cylinder lock 59 which is capable of preventing the door handle 13 from pulled up relative to the base body 1 is incorporated in the door handle 13 in a manner such that the locking member of the cylinder lock is prevented from moving toward its unlocked position by the combination lock. Due to this, even when it is necessary to reduce in thickness the door locking handle assembly in application, it is possible for the door locking handle assembly of the present invention to provide a very large number of eligible keys and permit a very large number of eligible users to have access to their instruments of the box in an easy manner through the computerized personal management system, without fail.

While the present invention has been particularly shown and described with reference to the preferred embodiments and a modification thereof, it will be understood by those skilled in the art that various modifications and changes may be made therein without departing from the spirit of the present invention as defined by the appended claims.

What is claimed is:

1. In a door locking handle assembly provided with a base body (1) which is fixedly mounted on a door (2), wherein a door handle (13) is pivoted to said base body (1) so as to be capable of being pulled out and pushed down relative to said base body (1) and also turned on its pivoted end, wherein a lock plate (11) directly or indirectly connected with said door handle (13) is disengaged from a receiving portion (18) of a stationary frame element (17) such as a main body of a box when said door handle (13) is pulled out and turned or turned after its pulling-out operation, the improvement wherein:

a combination lock (19), which is provided with a plurality of marked dial disks (21), is incorporated in either said door handle (13) or said base body (1) and opened by turning each of said marked dial disks (21) a given number of times to establish a predetermined combination of marks provided in outer peripheral surfaces of said dial disks (21); and a cylinder lock (59) for preventing said door handle (13) from being pulled out of said base body (1) is incorporated in said door handle (13) to have a locking member of the cylinder lock prevented from moving in its unlocking direction by said combination lock (19).

2. The door locking handle assembly of claim 1, wherein said cylindrical lock (59) has a lower cam projection (62) which contacts an elongated locking member (64) having a lower end portion which contacts a receiving portion (69) formed in said base body (1), and thereby provides a locking action for said door handle (13) in said base body (1).

3. The door locking handle assembly of claim 2, wherein said elongated locking member (64) has an upper end (67) which contacts a movable spring-supported plate (26), said plate (26) having a plurality of portions which each contact a cam disk (22) located adjacent to said marked disk (21), whereby whenever the marked disks (21) are turned to an unlocked position, said elongated locking member (64) is released from contact with said receiving portion (69) of said base body (1).

4. The door locking handle assembly of claim 1 wherein said marked dial disks (21) are mounted alternately adjacent to a plurality of cam disks (22) mounted on an elongated support shaft (20) which is fixedly mounted longitudinally in said door handle (13).

5. The door locking handle assembly of claim 4 wherein said marked dial disks (21) are each releasably attached to said adjacent cam disks (22) and said cam disks (22) each have a flat surface portion 29.

6. The door locking handle assembly of claim 5 wherein said combination lock (19) includes within a concave portion of said handle (13) a spring-biased sliding plate member (24) having a plurality of detecting plate portions (30) wherein each contact the outer peripheral surface and said flat surface portions (29) of said cam disks (22).

7. The door locking handle assembly of claim 6 wherein said locking member (44) is pivotally attached to one end portion of said sliding plate member (24), so that when said detecting plate portions (30) are moved to contact at least one said flat surface portion (29), said locking member (44) is disengaged from a receiving portion (49) of said base body (1) and permits said door handle (13) from being pulled out of said base body (1).

* * * * *